US007377524B2

(12) United States Patent
Lok

(10) Patent No.: US 7,377,524 B2
(45) Date of Patent: May 27, 2008

(54) ROLLER SKATE

(76) Inventor: Pak Yan Lok, Room 717, Yuk Shek House, Ping Shek Estate, Wong Tai Sin, Kowloon (HK)

( * ) Notice: Subject to any disclaimer, the term of this patent is extended or adjusted under 35 U.S.C. 154(b) by 227 days.

(21) Appl. No.: 11/211,410

(22) Filed: Aug. 24, 2005

(65) Prior Publication Data

US 2006/0108754 A1 May 25, 2006

(30) Foreign Application Priority Data

Nov. 19, 2004 (HK) ..... 1069278

(51) Int. Cl.
*A63C 17/00* (2006.01)

(52) U.S. Cl. ..... 280/11.3; 280/11.27

(58) Field of Classification Search ..... 280/11.19, 280/11.3, 11.31, 11.12, 11.15, 11.26, 11.27, 280/11.204, 11.207, 11.208
See application file for complete search history.

(56) References Cited

U.S. PATENT DOCUMENTS 2,070,646 A * 2/1937 Blochinger ..... 280/11.223
3,526,976 A * 9/1970 Jacobs ..... 36/100
4,070,029 A * 1/1978 Panarelli ..... 280/11.19
4,153,263 A * 5/1979 Yoshimoto ..... 280/843
5,067,736 A * 11/1991 Olson et al. ..... 280/11.208
5,393,077 A * 2/1995 Wanous ..... 280/7.13
6,334,621 B1 1/2002 Chang ..... 280/11.3
6,382,638 B1 * 5/2002 Lee ..... 280/7.13
2002/0163143 A1 11/2002 Hong ..... 280/11.3

FOREIGN PATENT DOCUMENTS

| | | |
|---|---|---|
| CN | 2456770 | 10/2001 |
| CN | 2456777 | 10/2001 |
| CN | 2481375 | 3/2002 |
| EP | 1331027 | 7/2003 |

* cited by examiner

*Primary Examiner*—Frank Vanaman
(74) *Attorney, Agent, or Firm*—J.C. Patents

(57) ABSTRACT

A roller skate includes a shoe body and a wheel portion comprising a front wheel assembly and a rear wheel assembly. The front wheel assembly and the rear wheel assembly can be easily attached to or detached from an underside of the shoe body without tools. The present invention provides a shoe that can be easily converted from a walking or running shoe to a roller skate and vice versa. It is comfortable for the wearer to skate with such roller skate. Moreover, there is no limitation to the size of the roller.

24 Claims, 4 Drawing Sheets

ROLLER SKATE

CROSS-REFERENCE TO RELATED APPLICATION

This application claims priority benefit of Hong Kong Short-Term Patent No. HK1069278 filed on Nov. 19, 2004, the content of which is hereby incorporated by reference in its entirety.

TECHNICAL FIELD

The present invention relates to a roller skate, and in particular to a roller skate whose wheel can be easily attachable and detachable.

BACKGROUND ART

Various roller skates emerge as the roller skating becomes popular. In order to provide the roller skating fans with a kind of shoes for both walking and skating, the so-called "Gustily Walking Shoes" appears on the market, which comprises in-line wheels at the heel, the wheels being in a same plane as the sole. The wearer can walk as usual, and skate by lifting the tiptoe on the ground suitable for roller skating. Although such Gustily Walking Shoes have both functions of walking and skating, the wearer must lift the front sole of the foot while straining at the heel during skating, unable to skate easily with normal posture.

The patent patents CN2481375Y, CN2456777Y and US2002/0163143A1 also disclose some roller skates having retractable wheels. Such shoes are characterized in that the sole comprises a recess for receiving the wheels which can be stretched out of or folded in the recess, thereby achieving both functions of skating and walking. Nevertheless, the wheels are still received inside the recess of the shoe sole when not in use and thus burden the user during walking. In addition, since the wheels have to be received at an underside of the shoe, the diameter of the wheel will be limited such that the speedy and laborsaving effect during skating will be watered down.

The patent U.S. Pat. No. 6,344,621B1 also discloses a roller skate, which becomes a roller skate by engaging the sole and wheel portion through a threaded joint member, or becomes shoes for normal walking by loosening the threaded joint member. The drawback of such shoes is that the threaded engagement requires particular tools and the wheels can not be freely attached and detached during wearing, which leads to inconvenience of use.

SUMMARY OF THE INVENTION

In view of the various problems existing in the prior art, the object of the present invention is to provide a roller skate with wheels which are easily attachable and detachable. The wearer can attach and detach the wheels according to the places or his own favor, freely convertible between walking and skating.

In order to achieve the above said object, the present invention provide a roller skate including a shoe body and a wheel portion, the sole of the shoe body being provided with a front slot and a rear slot, and the wheel portion including a front wheel assembly and a rear wheel assembly. The front wheel assembly includes a front support which has a T-shaped upper end to engage with said front slot and a lower end mounted with a front wheel axle, a front wheel mounted on said front wheel axle, and a front cross beam perpendicularly connected to the middle part of said front support. The rear wheel assembly includes a rear support which has a T-shaped upper end to engage with said front slot and a lower end mounted with a rear wheel axle, a rear wheel mounted on said rear wheel axle, and a rear cross beam perpendicularly connected to the middle part of said rear support. Said front cross beam and rear cross beam are detachably engaged so as to form a stable rigid cross beam.

The present invention provides a shoe that can be easily converted from a walking or running shoe to a roller skate and vice versa by convenient attachment and detachment of the wheel portions without tools. It is comfortable for the wearer to skate with such roller skate because the sole of foot is placed in normal status. Moreover, there is no limitation to the size of the roller.

BRIEF DESCRIPTION OF THE DRAWINGS

The present invention is described with reference to the following drawings.

PREFERRED MODE FOR CARRYING OUT THE INVENTION

Figure 1:
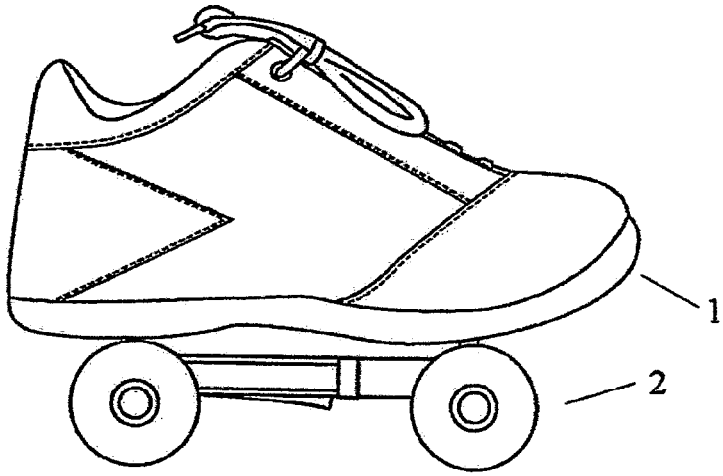
FIG. 1 is a schematic view of the roller skate of the present invention.
Figure 2:
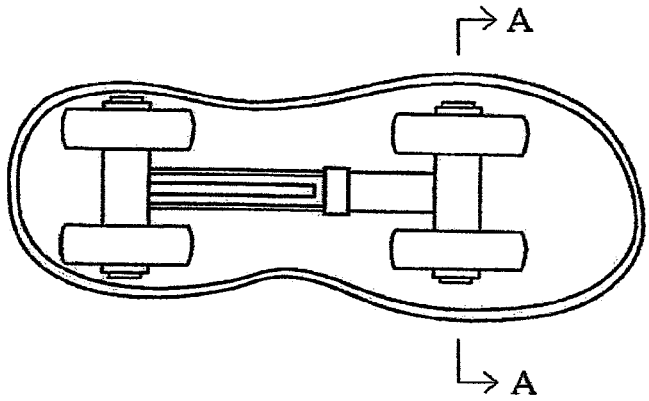
FIG. 2 is a bottom view of the FIG. 1.
Figure 3:
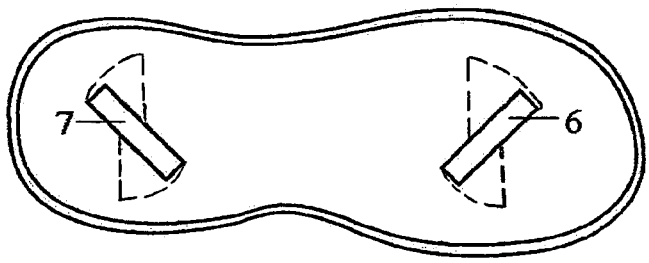
FIG. 3 is a schematic view of the sole illustrating a state that the wheels are detached.

As shown in the FIG. 1, the roller skate of the present invention primarily includes a shoe body 1 and a wheel portion 2, the wheel portion 2 further including a front wheel assembly 3 and a rear wheel assembly 4. The sole 5 of the shoe body 1 is provided at the underside a front slot 6 and a rear slot 7. The front wheel assembly 3 comprises a front support 8, a front wheel 9 and a front cross beam 10, and the rear wheel assembly 4 comprises a rear support 12, a rear wheel 13 and a rear cross beam 14. Both of the front support 8 and the rear support 12 are substantially T-shaped, and their upper ends engage with the front slot 6 and the rear slot 7 respectively and their lower ends are mounted with a front wheel axle 11 and a rear wheel axle 15 respectively. The front wheel 9 and the rear wheel 13 are mounted on the front wheel axle 11 and the rear wheel axle 15 respectively. The front cross beam 10 and the rear cross beam 14 are perpendicularly connected to the corresponding front support 8 and the rear support 12 respectively, and can be engaged so as to form a stable rigid cross beam between the front and rear supports, such that the wheel portion 2 can be fixedly and integrally engaged with the shoe body 1 for sliding. The front slot 6 and the rear slot 7 may take any well known shape, for example the "T" shape or the preferred shape shown in FIG. 3, i.e. the opening is a slant rectangle and the inner cavity is shaped as two substantially symmetrical sectors, whereby the support is inserted into the opening and rotates at an angle to the cross beam, and then is locked at the position in horizontal direction as shown in the FIG. 3.

Figure 9:
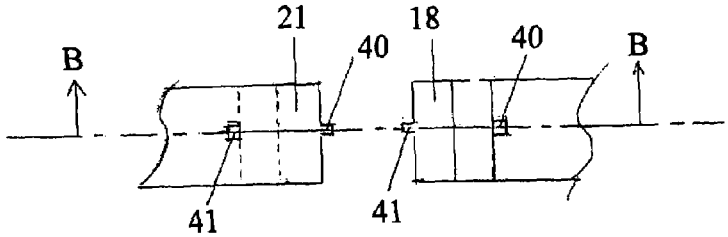
FIG. 9 is a schematic view of the first hook engaging end and the second hook engaging end in another preferred embodiment (not showing the stopper)
Figure 10:
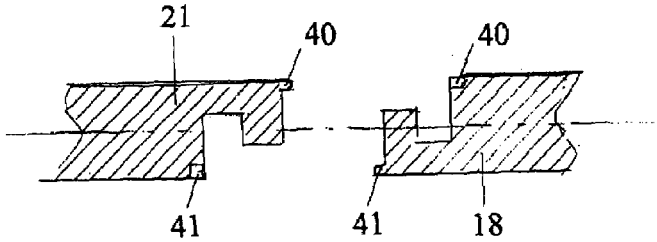
FIG. 10 is a sectional view taken along a line B-B in FIG. 9.

The front cross beam 10 and the rear cross beam 14 may take any engagement structure which is detachable. According to the first preferred embodiment of the present invention, the front cross beam 10 has a first engaging shaft 16 with a first hook engaging end 18, and a first sleeve 19, which is coaxial with the first engaging shaft 16 and can move relatively to the first engaging shaft 16. The first coil spring 30 is located between the first engaging shaft 16 and the first sleeve 19, one end thereof being fixed to the first sleeve 19 and the other end being fixed to the engaging shaft 16. The first engaging shaft 16 is longer than the first sleeve 19 such that the first hook engaging end 18 protrudes out of the first sleeve 19. The rear cross beam 14 has a second engaging shaft 17 with a second hook engaging end 21, and a second sleeve 20, which is coaxial with the second engaging shaft 17 and can not move relatively. The second engaging shaft 17 is longer than the second sleeve 20 such that the second hook engaging end 21 protrudes out of the second sleeve 20. The first engaging shaft 16 and the second engaging shaft 17 have same diameter. The first hook engaging end 18 and the second hook engaging end 21 have shapes complementary to each other, which can be engaged together to form a shaft shape having uniform diameter. As shown in FIGS. 9 and 10, in another preferred embodiment, the two hook engaging ends may have positioning bulges 40, 41 at the most front end which engage with the notches 40', 41' formed at the counterpart such that the first engaging shaft 16 and the second engaging shaft 19 do not move relatively after engaging with each other.

The rear cross beam 14 also comprises a second coil spring 22 located between the second sleeve 20 and the second engaging shaft 17, and a lock piece tube 23. The second hook engaging end 21 is provided with a stopper with spring for stopping the lock piece tube 23 when the second hook engaging end 21 is not engaged with the first hook engaging end 18, such that the lock piece tube 23 does not protrude out of the second sleeve 20. In this case, the coil spring 22 is in a state of being compressed. The stopper may be a stopping arm 24 which can rotate about a pin axis 25 disposed at the second hook engaging end 21, the stopping arm 24 including a first arm portion extending horizontally and a second arm portion substantially perpendicular to the first arm portion. In addition, there is a band spring 26 for supporting the second arm portion. When the first and the second hook engaging ends are engaged, the first arm portion of the stopping arm is pressed down so as to drive the second arm portion to retract radially, and the band spring 26 is deformed under force. When the lock piece tube 23 is loosened from the stopping status, it extends forwards under the restoring force of the spring 22 and enters into between the first sleeve 19 and the first engaging shaft 16. In order to prevent the lock piece tube 23 from swaying in axial direction or springing out unexpectedly when the front and the rear cross beams are disengaged, a limit protrusion may be formed on the outer surface of the lock piece tube, while a closed elongate opening is correspondingly formed on the second sleeve 20 for limiting the sliding of the lock piece tube. For the sake of good appearance and safety, a slot cover may be formed to surround the opening and to cover said limit protrusion at the same time.

Preferably, the first sleeve 19 comprises a claw 32 at the front end portion adjacent to the first engaging end, the tip of which claw is drawn in radially. The claw may be one or more distributed uniformly along the circumference. When it is required to disengage the front and the rear cross beams, the user pulls the first sleeve 19 forcibly such that it moves forwards by overcoming the acting force of the first coil spring 30. The claw 32 abuts against the lock piece tube 23 and pushes it back to the second sleeve 20. The lock piece tube 23 compresses the coil spring 22 backwardly. When the lock piece tube 23 crosses over the first hook engaging end 18, the first hook engaging end 18 is disengaged with the second hook engaging end 21 and no longer presses down the first arm portion of the stopping arm 24. In this way, the second arm portion of the stopping arm 24 protrudes radially along the second engaging shaft 17 under the restoring force of the band spring 26, and the lock piece tube 23 retracting along the second engaging shaft 17 and crossing over the second arm portion is stopped by the protruded second arm portion, and is prevented from springing out under the resilient force of the compressed coil spring 22. At this time, the user loosens the first sleeve 18, which is restored under the restoring force of the second coil spring 30. In order to realize the above operation, the length and position of the claw 32 protruding out of the first sleeve 18 are designed not to interfere with the second arm portion protruding radially. The protruding second arm portion is preferably flush with the end face of said second sleeve 20 so as to stop the lock piece tube 23 inside the second sleeve 20. The spring for providing restoring force to the stopping arm 24 may be a torsion spring, for replacing the band spring 26, mounted at the pin axis 25.

Figure 11:
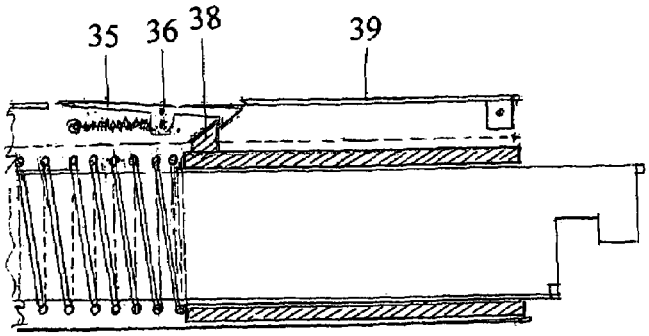
FIG. 11 is a schematic view illustrating the structure of the stopping lever and the lock piece tube in a further embodiment of the roller skate in the present invention.

The FIG. 11 shows the structure of the rear cross beam in another preferred embodiment of the present invention. Other structures of this embodiment are same as those of the above embodiment except that the stopping structure of the rear cross beam is not at the second engaging shaft but between the second sleeve 20 and the lock piece tube 23, which stopping structure comprises a stopper with spring on the second sleeve and a corresponding stopping protrusion 38 on the lock piece tube 23. The stopper may include a stopping lever 35, a pin axis 36 and a stopping spring 37. The center of the stopping lever 35 is mounted on and may pivot upon the pin axis 36 which is fixed on an abutment (not shown) protruding from the surface of the second sleeve 20. One end of the stopping lever 35 is hooked and cooperates with a stopping protrusion 38 so as to limit the movement of the lock piece tube 23. One end of the stopping spring 37 is secured to the second sleeve 20 and the other end is secured to the stopping lever 35. When the first hook engaging end 18 of the first engaging shaft 16 is engaged with the second hook engaging end 21 of the second engaging shaft 17, the stopping lever 35 is pressed manually to overcome the action force of the spring 37 for releasing the stopping protrusion 28, whereby the lock piece tube 23 springs out of the second sleeve 20 under the resilient force of the second coil spring 22, thus hitching the joints of the two engaging shafts. A closed opening is formed on the surface of the second sleeve 20 corresponding to the stopping protrusion 38 for guiding the slide of the stopping protrusion 38 so as to limit the rotation or excessive springing of the lock piece tube 23. For the sake of good appearance and safety, a slot cover 39 may be formed to cover the opening and the stopping protrusion 38. When it is required to disengage the two engaging shafts, the user pulls the first sleeve 18 such that the claw 32 abuts against the lock piece tube 23 and pushes it back to the second sleeve 20. The stopping protrusion 38 of the lock piece tube 23 is locked after it crosses over the hooked end of the stopping lever 35, and its movement is stopped. At this time, the joints of the two engaging shafts are exposed and disengaged for getting rid of the restriction. Thus, the structure of said embodiment also achieves the quick detachment.

Figure 5:
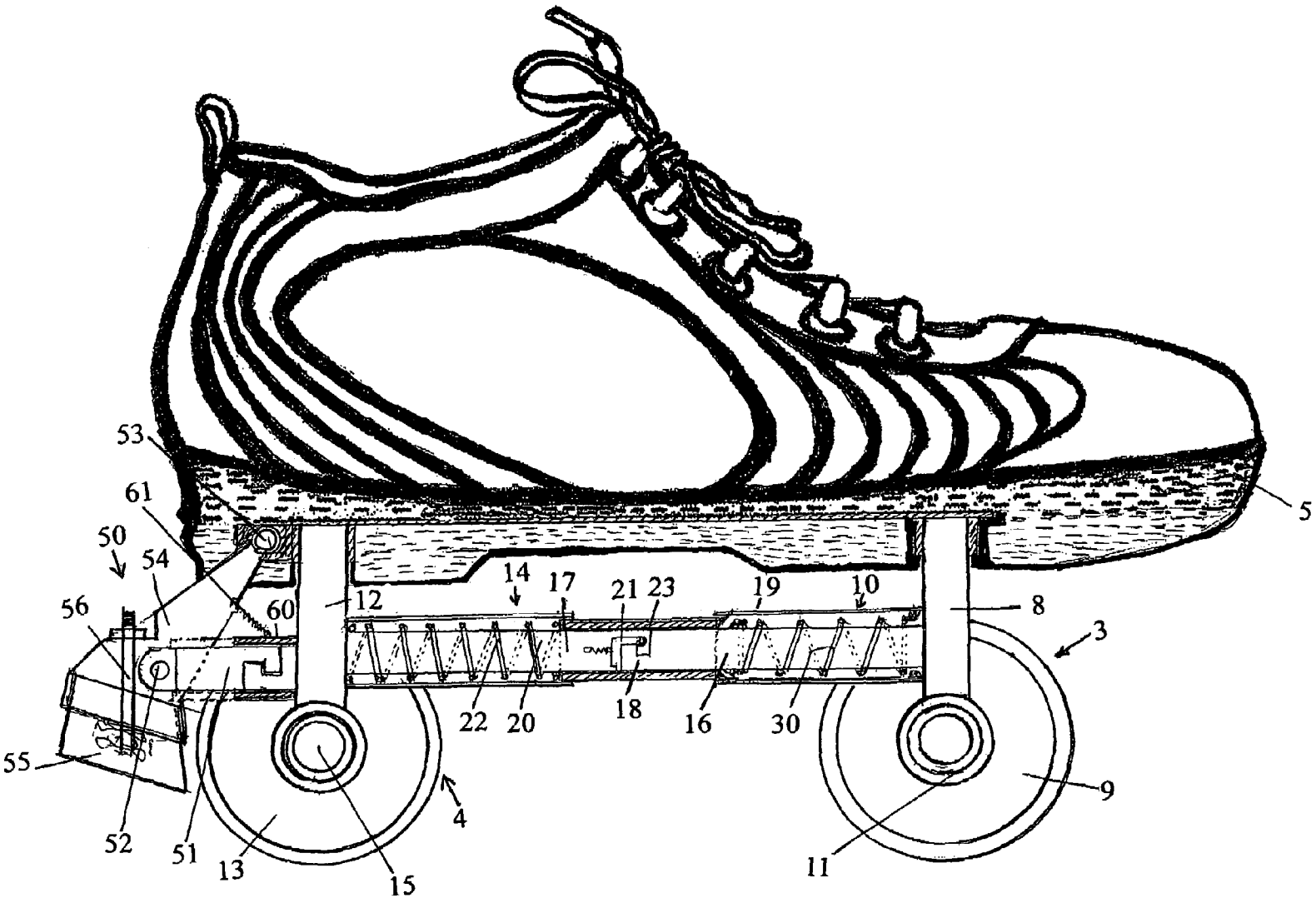
FIG. 5 is a vertical sectional view illustrating the engagement state of the sole and the wheel portion of one preferred embodiment of the roller skate in the present invention.
Figure 6:
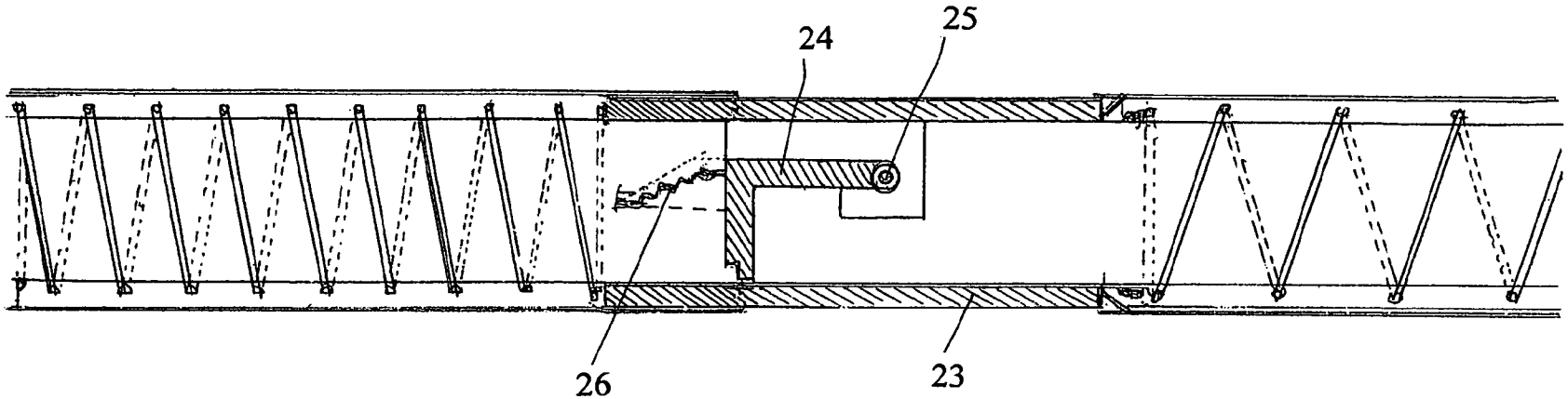
FIG. 6 is an enlarged schematic view of the engagement structure of the front and rear cross beams in the FIG. 5.
Figure 7:
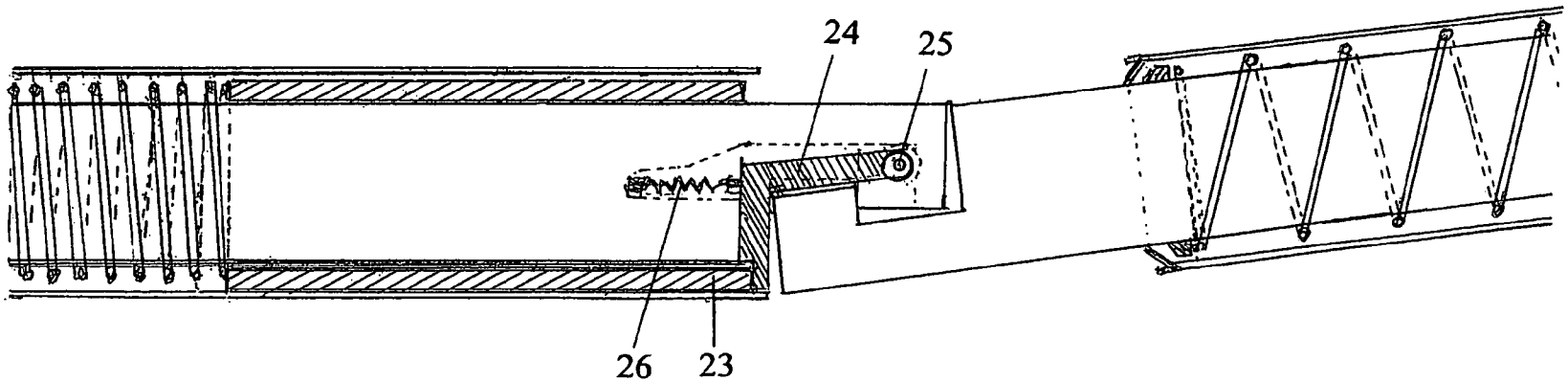
FIG. 7 is an enlarged schematic view illustrating the state that the engagement structure of the front and rear cross beams is disengaged.
Figure 4:
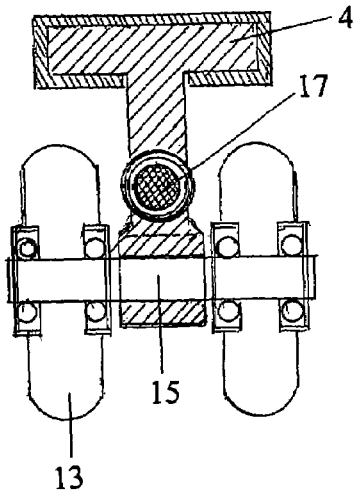
FIG. 4 is a sectional view of the front wheel assembly taken along a line A-A in FIG. 2.
Figure 8:
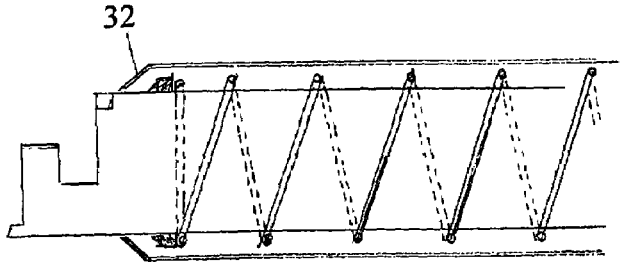
FIG. 8 is a schematic view of another preferred embodiment of the first sleeve in the present invention.

The roller skate of the present invention may also comprise a wheel braking means, for the use of unskillful beginner or emergency. Said braking means may be mounted on the rear wheels and may take the form of brake block with simple structure. In a preferred embodiment shown in the FIG. 5, said wheel braking means 50 comprises a support rod 51 fixed perpendicularly to the rear support 12 and extending backwardly, the end of the support rod having a fulcrum shaft 52 extending horizontally and being perpendicular to the support rod. A brake slot 53 is formed at the rear portion of the sole, and a brake rod 54 is mounted on the fulcrum shaft. One end of the brake rod is locked in the brake slot 53 and the other end is mounted with a brake block 55, which may be formed of the conventional abrasion resistant rubber. When the wearer of the roller skate needs to stop abruptly during the skating, he may lift the tiptoe slightly and press the heel such that the brake block contacts with the ground, increasing the frictional resistance and stopping the rotation of wheels for braking.

The brake slot 53 and the brake rod 54 of the braking means may each comprise two symmetrical with respect to the vertical plane where the support rod resides. The two brake rods are connected to each other at the end having brake block, and the brake block 55 is fixed to the end of said brake rod 55 through a bolt 56.

The support rod 51 of the braking means 30 may be secured to the rear support 12 in any known and appropriate manner. In the FIG. 5, the support rod 51 is in a form of shaft, including a first portion fixed to the rear support 12 and a second portion having a shape complementary to the shape of the first portion and combining with the first portion to form the support rod. In order for the first portion and the second portion to engage and disengage quickly, the braking means also comprises an engaging sleeve 60 and an engaging spring 61. When the first portion is engaged with the second portion, the engaging sleeve 60 is located at a first engaging position (as shown in the figure) for hitching the two portions, preventing them from loosening apart. When the engaging sleeve 60 moves left to a second disengaging position (not shown), the joints of the first portion and the second portion are exposed and loosened. One end of the engaging spring 61 is fixed to the brake rod 54 and the other end is fixed to the engaging sleeve 60. The rigidity of the engaging spring 61 is selected such that the spring is in a status of being compressed all the time. As shown in the figure, at the first engaging position, the engaging spring 61 and the engaging sleeve 60 form an obtuse angle therebetween, and the action force received by the engaging sleeve 60 from the spring 61 may, as shown, be divided into the force to the right horizontally and the force vertically upwards, such that the engaging sleeve 60 is retained at the first engaging position by abutting against the rear support 12. When the user pulls the engaging sleeve 61 to move to the left, the first portion and the second portion are disengaged and the engaging sleeve 61 enters into the second disengaging position. At this time, the engaging spring 61 and the engaging sleeve 60 form an acute angle therebetween, and the action force received by the engaging sleeve 60 from the spring 61 may be divided into the force to the left horizontally and the force vertically upwards, such that the engaging sleeve 61 is retained at the second disengaging position by abutting to the left against the fulcrum shaft 52. When the user intends not to use the braking means, it is easy for him to retract the brake rod 54 from the brake slot 53 and to disconnect the first portion and the second portion of the support rod 51, thereby detach the braking means.

Although the invention has been described with reference to the accompanying drawings, it is to be understood that many other possible modifications and variations can be made by those skilled in the art without departing from the spirit and scope of the invention.

What is claimed is:

1. A roller skate including a shoe body and a wheel portion, characterized in that the sole of the shoe body is provided with a front slot and a rear slot, and the wheel portion includes a front wheel assembly and a rear wheel assembly, wherein the front wheel assembly includes a front support which has a T-shaped upper end and a lower end mounted with a front wheel axle, a front wheel mounted on said front wheel axle, and a front cross beam perpendicularly connected to a middle part of said front support, the T-shaped end of said front support is sized so as to be able to pass through said front slot and, by rotating an angle relative to said front slot, to engage with said front slot; the rear wheel assembly includes a rear support which has a T-shaped upper end and a lower end mounted with a rear wheel axle, a rear wheel mounted on said rear wheel axle, and a rear cross beam perpendicularly connected to a middle part of said rear support; said front cross beam and rear cross beam are detachably engaged so as to form a stable rigid cross beam, the T-shaped end of said rear support is sized so as to be able to pass through said rear slot and, by rotating an angle relative to said rear slot, to engage with said rear slot.

2. The roller skate as set forth in claim 1, characterized in that: the front cross beam has a first engaging shaft with a first hook engaging end, and a first sleeve, which is coaxial with the first engaging shaft and can move relative to the first engaging shaft; a first coil spring is located between the first sleeve and the first engaging shaft, one end thereof being fixed to the first sleeve and the other end being fixed to the engaging shaft; the rear cross beam has a second engaging shaft with a second hook engaging end, and a second sleeve, which is coaxial with the second engaging shaft and can not move relative to the second engaging shaft; a second coil spring and a lock piece tube are located between the second engaging shaft and the second sleeve; the lock piece tube is biased by the second coil spring, the second sleeve is provided with a stopper, and the lock piece tube is provided with a corresponding stopping protrusion, wherein when the first hook engaging end and the second hook engaging end are disengaged, the lock piece tube overcomes the biasing force of the second coil spring and is pushed back to the second sleeve, the stopping protrusion being locked by cooperating with said stopper; when the first hook engaging end and the second hook engaging end are engaged and the stopper is released manually, the lock piece tube protrudes out of the second sleeve under the action of the second coil spring so as to cover the first engaging shaft and the second engaging shaft in an engaging status between the first sleeve and the second sleeve.

3. The roller skate as set forth in claim 2, characterized in that: an elongated opening is formed on the second sleeve at a place corresponding to the stopping protrusion such that the lock piece tube may slide and its relative rotation and sliding range are limited.

4. The roller skate as set forth in claim 3, characterized in that: a slot cover is formed on the outer surface of the second sleeve so as to surround the elongated opening.

5. The roller skate as set forth in claim 2, characterized in that: the stopper includes a stopping lever, a pin axis and a stopping spring, the center of the stopping lever being mounted on and pivoting upon the pin axis which is fixed on an abutment protruding from a surface of the second sleeve, one end of the stopping lever being hooked with the stopping protrusion; one end of the stopping spring being secured to the second sleeve and the other end being secured to the stopping lever.

6. The roller skate as set forth in claim 2, characterized in that: the first engaging shaft and the second engaging shaft have same diameter, and the first hook engaging end and the second hook engaging end have shapes complementary to each other, which can be engaged together to form a shaft shape having uniform diameter.

7. The roller skate as set forth in claim 2, characterized in that: the first sleeve comprises a claw at a front end portion adjacent to the first hook engaging end, a tip of the claw is drawn in radially; the first sleeve moves forwards when the first engaging shaft and the second engaging shaft in an engaging status are to be disconnected, and said claw abuts against the lock piece tube and pushes it back to the second sleeve.

8. The roller skate as set forth in claim 7, characterized in that: more than one claw are distributed uniformly along a circumference of the first sleeve, the position and length of the claw being designed not to interfere with the stopper of the lock piece tube.

9. The roller skate as set forth in claim 1, characterized in that: the front cross beam has a first engaging shaft with a first hook engaging end, and a first sleeve, which is coaxial with the first engaging shaft and can move relative to the first engaging shaft; a first coil spring is located between the first sleeve and the first engaging shaft, one end thereof being fixed to the first sleeve and the other end being fixed to the first engaging shaft; the rear cross beam has a second engaging shaft with a second hook engaging end, and a second sleeve, which is coaxial with the second engaging shaft and can not move relative to the second engaging shaft; a second coil spring and a lock piece tube are located between the second engaging shaft and the second sleeve; the lock piece tube is biased by the second coil spring, the second hook engaging end is provided with a stopper having a stopping spring, wherein when the second hook engaging end is not engaged with the first hook engaging end, the stopper protrudes along a radial direction of the second engaging shaft under the resilient force of the stopping spring so as to stop the lock piece tube; when the first hook engaging end is engaged with the second hook engaging end, the first hook engaging end presses down said stopper, and the lock piece tube enters between the first engaging shaft and the first sleeve under the action of the second coil spring, so as to cover the first engaging shaft and the second engaging shaft in an engaging status between the first sleeve and the second sleeve.

10. The roller skate as set forth in claim 9, characterized in that: said stopper comprises a stopping arm including a first arm portion rotatable around a pin axis disposed at the second hook engaging end and a second arm portion substantially perpendicular to the first arm portion; when the first hook engaging end and the second hook engaging end are engaged, the first arm portion is pressed down so as to drive the second arm portion to retract along a radial direction of the second engaging shaft, thus releasing the lock piece tube.

11. The roller skate as set forth in claim 10, characterized in that: said stopper further comprises a band spring for supporting the second arm portion.

12. The roller skate as set forth in claim 9, characterized in that: a stopping protrusion is formed on the outer surface of said lock piece tube, and an elongated opening is formed on the second sleeve for engaging with the stopping protrusion such that the lock piece tube may slide and its relative rotation and sliding range are limited.

13. The roller skate as set forth in claim 9, characterized in that: the stopper is flush with an end portion of said second sleeve in a stopping status so as to stop the lock piece tube inside the second sleeve.

14. The roller skate as set forth in claim 1, characterized in further comprising wheel braking means.

15. The roller skate as set forth in claim 14, characterized in that: said wheel braking means is a brake block mounted on the rear wheel assembly.

16. The roller skate as set forth in claim 15, characterized in that: said brake block is formed of abrasion resistant rubber.

17. The roller skate as set forth in claim 14, characterized in that: said wheel braking means comprises a support rod fixed perpendicularly to the rear support and extending backwardly, one end of the support rod having a fulcrum shaft extending horizontally and being perpendicular to the support rod; a brake slot formed at a rear portion of the sole; a brake rod, one end of which is inserted into the brake slot for fixing and the other end is mounted with a brake block, wherein the brake rod is mounted on the fulcrum shaft.

18. The roller skate as set forth in claim 17, characterized in that: said brake slot and brake rod each comprises two portions symmetrical with respect to a vertical plane where the fulcrum shaft resides.

19. The roller skate as set forth in claim 18, characterized in that: the two portions of the brake rod are connected to each other at an end portion having a brake block.

20. The roller skate as set forth in claim 19, characterized in that: the brake block is fixed to the end portion of said brake rod through a bolt.

21. The roller skate as set forth in claim 17, characterized in that: the support rod includes a first portion fixed to the rear support, and a second portion having a shape complementary to the shape of the first portion and combining with the first portion; the wheel braking means also comprises an engaging sleeve and an engaging spring, wherein when the first portion is engaged with the second portion, the engaging sleeve is located at a first engaging position for hitching the two portions, preventing them from loosening apart, and when the engaging sleeve moves to a second disengaging position, the first portion is disengaged with the second portion; one end of the engaging spring is fixed to the brake rod and the other end is fixed to the engaging sleeve, the engaging spring being in a status of being compressed all the time such that the engaging sleeve may position at the first engaging position and the second disengaging position respectively.

22. A roller skate including a shoe body and a wheel portion, characterized in that the sole of the shoe body is provided with a front slot and a rear slot, and the wheel portion includes a front wheel assembly and a rear wheel assembly, wherein the front wheel assembly includes a front support which has a T-shaped upper end to engage with said front slot and a lower end mounted with a front wheel axle, a front wheel mounted on said front wheel axle, and a front cross beam perpendicularly connected to a middle part of said front support; the rear wheel assembly includes a rear support which has a T-shaped upper end to engage with said rear slot and a lower end mounted with a rear wheel axle, a rear wheel mounted on said rear wheel axle, and a rear cross beam perpendicularly connected to a middle part of said rear support; said front cross beam and rear cross beam are detachably engaged so as to form a stable rigid cross beam;

wherein the front cross beam has a first engaging shaft with a first hook engaging end, and a first sleeve, which is coaxial with the first engaging shaft and can move relative to the first engaging shaft; a first coil spring is located between the first sleeve and the first engaging shaft, one end thereof being fixed to the first sleeve and the other end being fixed to the engaging shaft; the rear cross beam has a second engaging shaft with a second hook engaging end, and a second sleeve, which is coaxial with the second engaging shaft and can not move relative to the second engaging shaft; a second coil spring and a lock piece tube are located between the second engaging shaft and the second sleeve; the lock piece tube is biased by the second coil spring, the second sleeve is provided with a stopper, and the lock piece tube is provided with a corresponding stopping protrusion, wherein when the first hook engaging end and the second hook engaging end are disengaged, the lock piece tube overcomes the biasing force of the second coil spring and is pushed back to the second sleeve, the stopping protrusion being locked by cooperating with said stopper; when the first hook engaging end and the second hook engaging end are engaged and the stopper is released manually, the lock piece tube protrudes out of the second sleeve under the action of the second coil spring so as to cover the first engaging shaft and the second engaging shaft in an engaging status between the first sleeve and the second sleeve.

23. A roller skate including a shoe body and a wheel portion, characterized in that the sole of the shoe body is provided with a front slot and a rear slot, and the wheel portion includes a front wheel assembly and a rear wheel assembly, wherein the front wheel assembly includes a front support which has a T-shaped upper end to engage with said front slot and a lower end mounted with a front wheel axle, a front wheel mounted on said front wheel axle, and a front cross beam perpendicularly connected to a middle part of said front support; the rear wheel assembly includes a rear support which has a T-shaped upper end to engage with said rear slot and a lower end mounted with a rear wheel axle, a rear wheel mounted on said rear wheel axle, and a rear cross beam perpendicularly connected to a middle part of said rear support; said front cross beam and rear cross beam are detachably engaged so as to form a stable rigid cross beam;

wherein the front cross beam has a first engaging shaft with a first hook engaging end, and a first sleeve, which is coaxial with the first engaging shaft and can move relative to the first engaging shaft; a first coil spring is located between the first sleeve and the first engaging shaft, one end thereof being fixed to the first sleeve and the other end being fixed to the first engaging shaft; the rear cross beam has a second engaging shaft with a second hook engaging end, and a second sleeve, which is coaxial with the second engaging shaft and can not move relative to the second engaging shaft; a second coil spring and a lock piece tube are located between the second engaging shaft and the second sleeve; the lock piece tube is biased by the second coil spring, the second hook engaging end is provided with a stopper having a stopping spring, wherein when the second hook engaging end is not engaged with the first hook engaging end, the stopper protrudes along a radial direction of the second engaging shaft under the resilient force of the stopping spring so as to stop the lock piece tube; when the first hook engaging end is engaged with the second hook engaging end, the first hook engaging end presses down said stopper, and the lock piece tube enters between the first engaging shaft and the first sleeve under the action of the second coil spring, so as to cover the first engaging shaft and the second engaging shaft in an engaging status between the first sleeve and the second sleeve.

24. A roller skate including a shoe body and a wheel portion, characterized in that the sole of the shoe body is provided with a front slot and a rear slot, and the wheel portion includes a front wheel assembly and a rear wheel assembly, wherein the front wheel assembly includes a front support which has a T-shaped upper end to engage with said front slot and a lower end mounted with a front wheel axle, a front wheel mounted on said front wheel axle, and a front cross beam perpendicularly connected to a middle part of said front support; the rear wheel assembly includes a rear support which has a T-shaped upper end to engage with said rear slot and a lower end mounted with a rear wheel axle, a rear wheel mounted on said rear wheel axle, and a rear cross beam perpendicularly connected to a middle part of said rear support; said front cross beam and rear cross beam are detachably engaged so as to form a stable rigid cross beam;

wherein the roller skate further comprises wheel braking means, said wheel braking means comprises a support rod fixed perpendicularly to the rear support and extending backwardly, one end of the support rod having a fulcrum shaft extending horizontally and being perpendicular to the support rod; a brake slot formed at a rear portion of the sole; a brake rod, one end of which is inserted into the brake slot for fixing and the other end is mounted with a brake block, wherein the brake rod is mounted on the fulcrum shaft.

* * * * *